United States Patent [19]

Newsome et al.

[11] Patent Number: 4,588,081

[45] Date of Patent: May 13, 1986

[54] FOLDING CARTON AND BLANK THEREFOR, FOR CIGARETTES

[75] Inventors: Reginald W. Newsome, Richmond; James E. Hall, Mechanicsville, both of Va.

[73] Assignee: Philip Morris Incorporated, New York, N.Y.

[21] Appl. No.: 704,484

[22] Filed: Feb. 22, 1985

[51] Int. Cl.[4] ..... B65D 85/10

[52] U.S. Cl. ..... 206/251; 206/263; 206/273; 229/23 BT; 229/44 CB

[58] Field of Search ..... 206/249-251, 206/261, 268, 270, 271, 273, 263; 229/1.5 R, 6 R, 23 BT, 44 CB

[56] References Cited

U.S. PATENT DOCUMENTS

| | | | |
|---|---|---|---|
| 1,007,113 | 10/1911 | Kazian | 206/251 |
| 1,192,707 | 7/1916 | Thorndike | 206/251 |
| 2,132,339 | 10/1938 | Zipper | 206/251 |
| 2,234,649 | 3/1941 | Meincke | 206/251 |
| 2,894,619 | 7/1959 | Gallo | 206/48 |
| 2,947,413 | 8/1960 | Tuomala et al. | 206/41.1 |
| 2,950,060 | 8/1960 | Von Rudeen | 229/44 |
| 3,052,398 | 9/1962 | Benjamin | 229/20 |
| 3,058,646 | 10/1962 | Guyer | 229/44 |
| 3,102,675 | 9/1963 | Schrom | 229/20 |
| 3,165,249 | 1/1965 | Peck | 225/43 |
| 3,245,525 | 4/1966 | Shoemaker | 206/41.2 |
| 3,645,382 | 2/1972 | Abrams | 206/45.21 |

FOREIGN PATENT DOCUMENTS

| | | | |
|---|---|---|---|
| 0663292 | 7/1938 | Fed. Rep. of Germany | 206/251 |
| 0461794 | 2/1937 | United Kingdom | 206/250 |
| 1263203 | 2/1972 | United Kingdom | 206/261 |
| 1335683 | 10/1973 | United Kingdom . | |
| 1448629 | 9/1976 | United Kingdom . | |

*Primary Examiner*—William Price
*Assistant Examiner*—Jimmy G. Foster
*Attorney, Agent, or Firm*—Jeffrey H. Ingerman

[57] ABSTRACT

A paperboard cigarette pack having a pop-up feature is provided. The pack has a caddy member and front and back cover members. The cover members are hinged together at the bottom and are connected to the caddy member by lifting webs. Opening the cover members causes the caddy member to project vertically from the pack.

7 Claims, 10 Drawing Figures

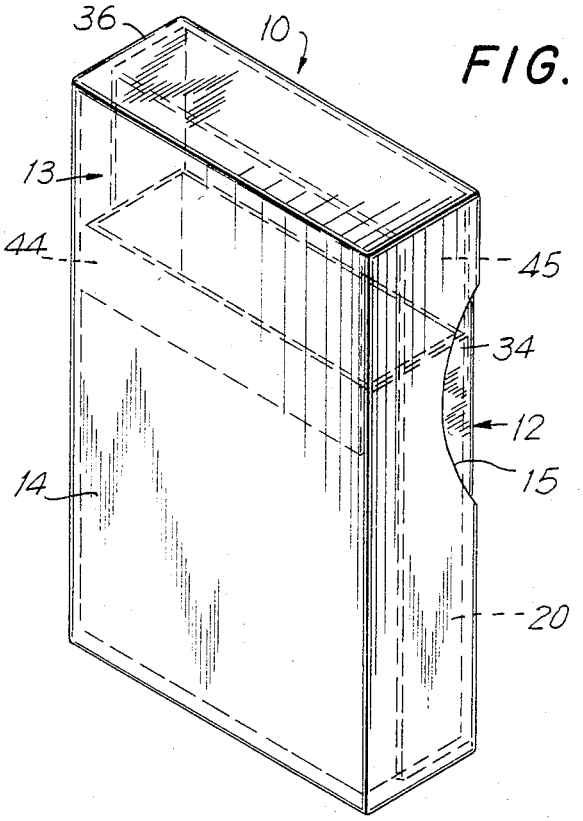
FIG. 1
FIG. 2
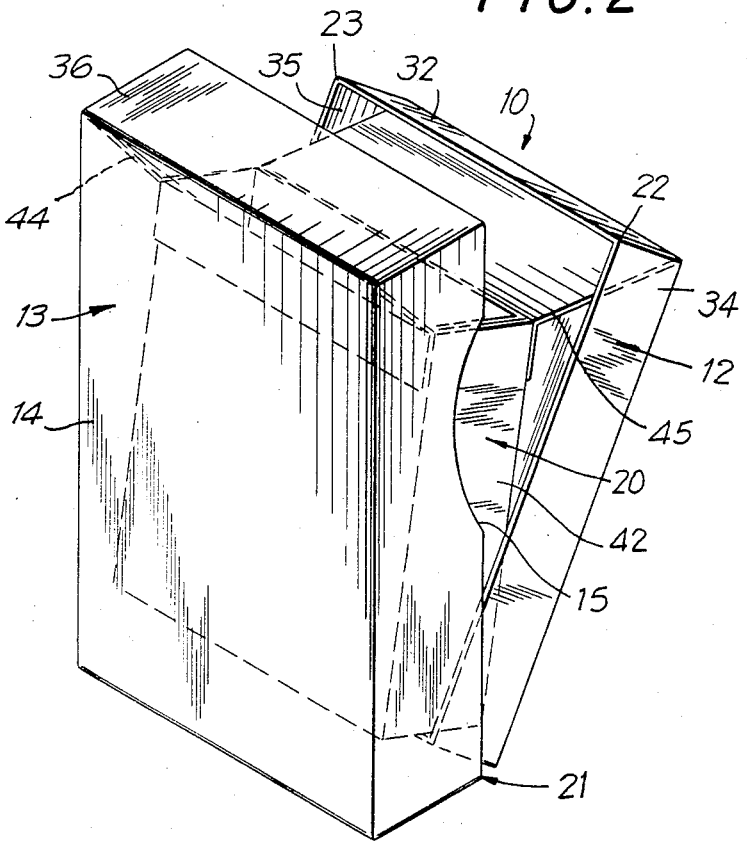

FIG. 8
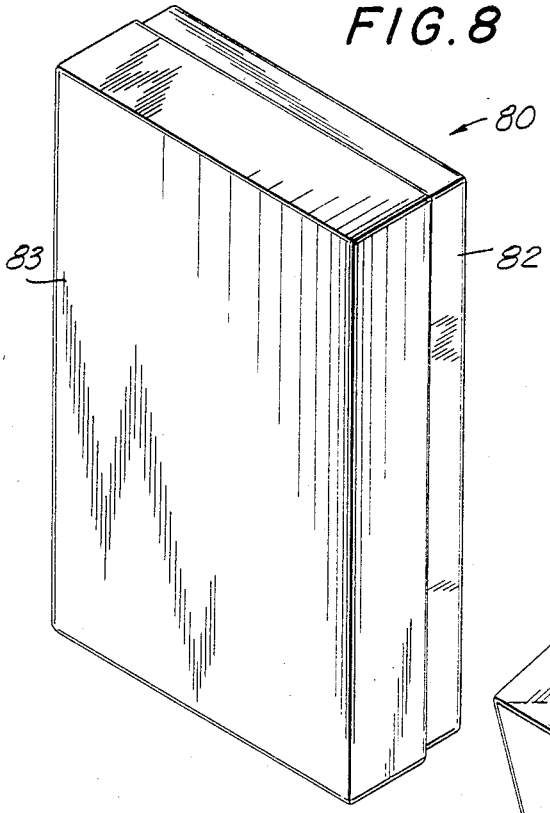
FIG. 9
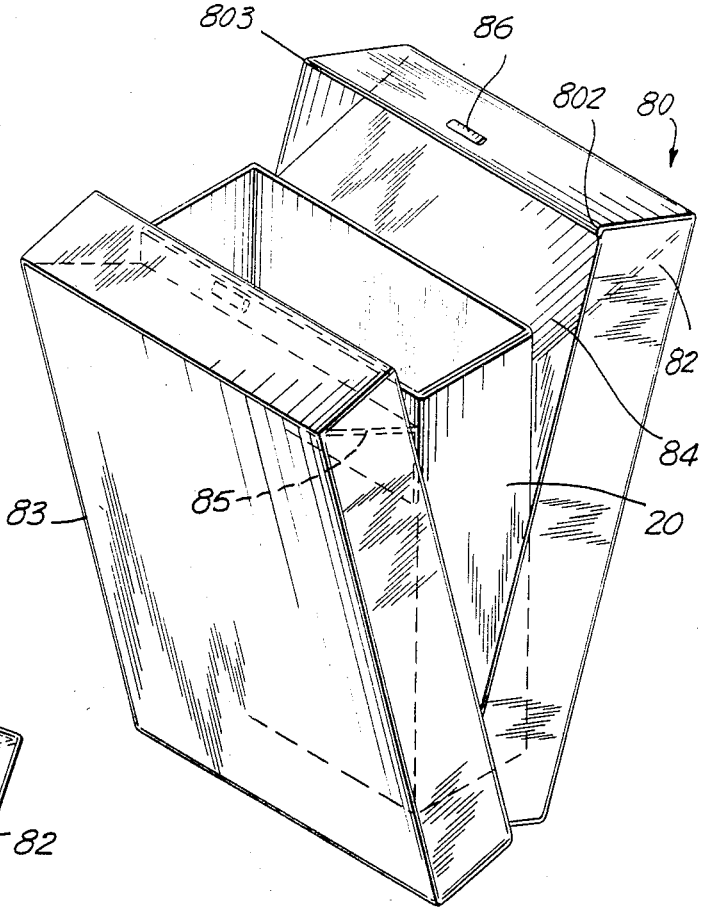
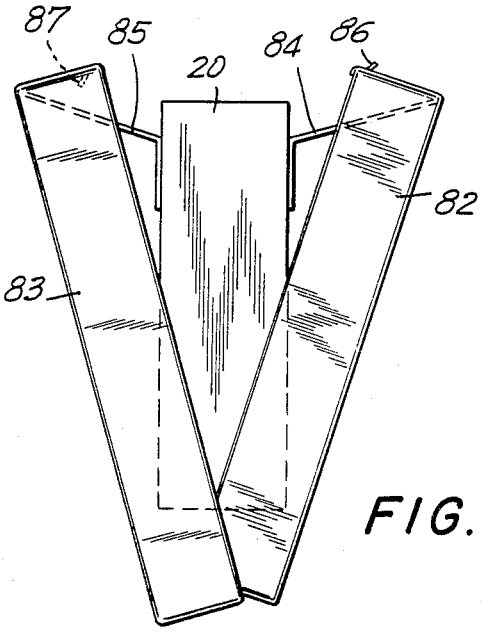
FIG. 10

FOLDING CARTON AND BLANK THEREFOR, FOR CIGARETTES

BACKGROUND OF THE INVENTION

This invention relates to folding cartons and blanks therefor, particularly to cigarette packs, and more particularly to a pop-up cigarette box.

Cigarettes are typically sold in packs of twenty to twenty-five cigarettes. Two types of packs are in general use. The first type is the "soft pack," which is a bundle of cigarettes wrapped in foil, overwrapped with a paper wrapper which usually has brand and other information printed on its outer side, and overwrapped again with a sealed cellophane layer. The second type is the "box" or "Flip-Top ® box," which is a hard paperboard box containing a foil-wrapped cigarette bundle and having a hinged lid at the top. Typically, a paperboard insert surrounds the bundle at least near the top of the box, providing a frictional engagement surface to retain the lid in the closed position when desired. A cutout in this insert allows a smoker to remove cigarettes from the box.

Each type of pack has its own advantages and disadvantages. The soft pack collapses as cigarettes are removed from it, taking up less space in a smoker's pocket or purse as the contents are smoked, while providing an approximate external indication of the number of cigarettes remaining in the pack. However, once the cellophane wrapper of a soft pack is opened, it cannot be resealed. As a result, any loose tobacco in the pack may eventually drop from the pack into the smoker's pocket or purse. The cigarettes can also be damaged if the pack is roughly handled. For these reasons, many smokers prefer the Flip-Top ® box, which can be resealed to prevent loose tobacco from dropping out, and which offers better protection for the cigarettes within it.

SUMMARY OF THE INVENTION

It is an object of this invention to provide a cigarette pack which will prevent the dropping out of loose tobacco.

It is also an object of this invention to provide a cigarette pack of increased attractiveness to smokers.

In accordance with the invention, a folding carton is provided having a pop-up inner box. The carton has a caddy member and front and back cover members. The caddy member is of a solid rectangular shape and has a height shorter than the length of cigarette, a width approximately an integral multiple of the diameter of a cigarette, and a depth sufficient to accommodate a plurality of rows of cigarettes. The caddy member has front and back walls defined by the height and the width, side walls defined by the height and the depth, and a bottom wall defined by the width and the depth. The back cover member has a height substantially the length of a cigarette and has back, top and bottom walls and two side walls nestingly engaging the back, side and bottom walls of the caddy member. The front cover member has front, top and bottom walls and two side walls, and nestingly engages the front wall of the caddy member and the top, bottom and side walls of the back cover member. A hinge connects the front and back cover members for pivoting them between an open position and closed position. Lifting means connects at least one of the cover members to the caddy member for causing the caddy member to project from between the cover members when they are open and to retract between them when they are closed.

BRIEF DESCRIPTION OF THE DRAWINGS

The above and other objects and advantages of the invention will be apparent from consideration of the following detailed description, taken to conjunction with the accompanying drawings, in which like reference characters refer to like parts throughout, and in which:

FIG. 1 is a front perspective view of a preferred embodiment of a cigarette pack according to the invention in the closed position;

FIG. 2 is a front perspective view of the cigarette pack of FIG. 1 in the open position;

FIG. 8 is a front perspective view of an alternate embodiment of a cigarette pack according to the invention in the closed position;

FIG. 9 is a front perspective view of the cigarette pack of FIG. 8 in the open position; and FIG. 10 is a side elevational view of the cigarette pack of FIGS. 8 and 9 in the open position.

DETAILED DESCRIPTION OF THE INVENTION

Figure 3:
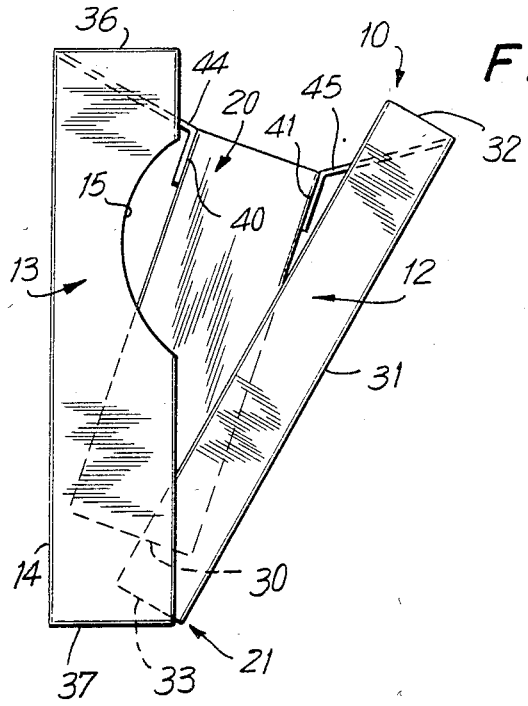
FIG. 3 is a side elevational view of the cigarette pack of FIGS. 1 and 2 in the open position.
Figure 4:
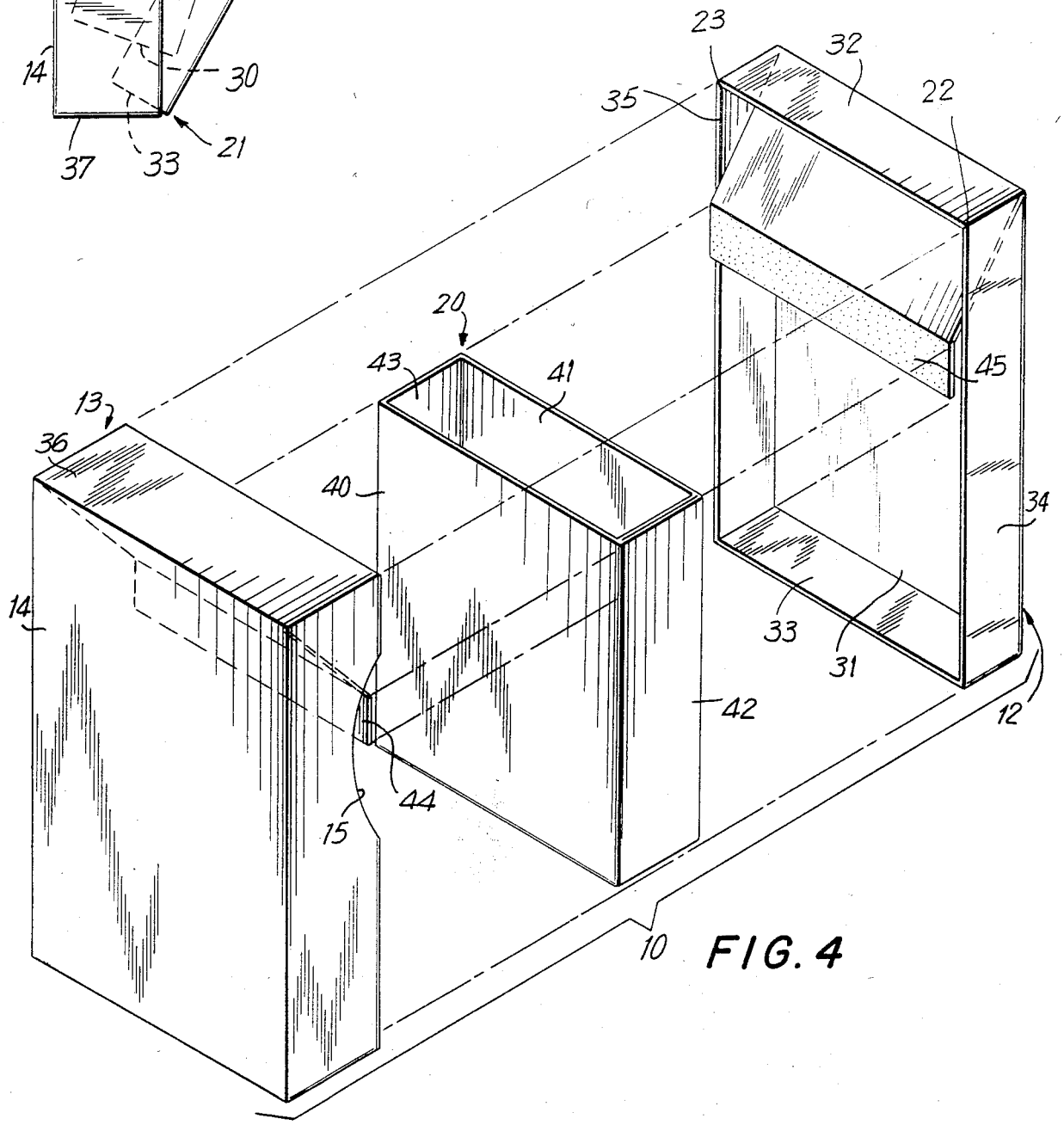
FIG. 4 is an exploded perspective view of the cigarette pack of FIGS. 1–3 showing the caddy and cover members and the lifting means.

A preferred embodiment of the folding carton of the present invention is the cigarette pack shown in FIGS. 1–4. Cigarette pack 10 includes a caddy member 20, a back cover member 12, and a front cover member 13, and when closed is similar in size and shape to known cigarette packs. Caddy member 20 differs from known Flip-Top ® boxes in the absence of a lid and in that it is shorter, so that when caddy member 20 is loaded with cigarettes, the cigarettes (not shown) protrude from caddy member 20 for easy withdrawal by the smoker. Caddy member 20 has front and back walls 40, 41, side walls 42, 43, and bottom 30.

Back cover member 12 has a back wall 31, top and bottom walls 32, 33, and side walls 34, 35. Front cover member 13 has a front wall 14, top and bottom walls 36, 37, a side wall 38 and a second side wall not shown. Back cover member 12 nestingly engages bottom, back and side walls, 30, 41, 42, 43 of caddy member 20. Front cover member 13, in turn, nestingly engages top, bottom and side walls 32, 33, 34, 35 of back cover member 12 and front wall 40 of caddy member 20. Front wall 40 of caddy member 20 is hinged to the inside top corner of front cover member 13 by lifting web 44, and back wall 41 of caddy member 20 is hinged to the inside top corner of back cover member 12 by lifting web 45. Back cover member 12 and front cover member 13 are hinged together at 21 for pivoting between the closed position shown in FIG. 1 and the open position shown in FIGS. 2 and 3.

As seen in FIG. 1, cigarette pack 10 resembles an ordinary Flip-Top ® box in size and shape when back and front cover members 12, 13 are in the closed position. Cover members 12, 13 are retained in the closed position by the frictional engagement of corners 22, 23 of back cover member 12 with the interior of top wall 36 of front cover member 13, thereby preventing the dropping out of loose tobacco from cigarette pack 10. Thumb notches 15 (one shown) are provided so that back cover member 12 can be grasped for opening.

When cigarette pack 10 is open, as seen in FIGS. 2 and 3, lifting webs 44, 45 pull caddy member 20 up from the bottom of cigarette pack 10 and cause it to project from the space between the cover members 12, 13. The tips of the cigarettes (not shown) in caddy member 11 preferably extend beyond the top walls 32, 36 of the cover members 12, 13. In the embodiment shown in FIGS. 1–4, front cover member 13 has a greater depth than rear cover member 12, so front lifting web 44 is made longer than rear lifting web 45 to enable caddy member 20 to clear front cover member 13 when cigarette pack 10 is open. As shown in phantom in FIG. 1, lifting webs 44, 45 also push caddy member 20 to the bottom of cigarette pack 10 when cigarette pack 10 is closed.

Figure 5:
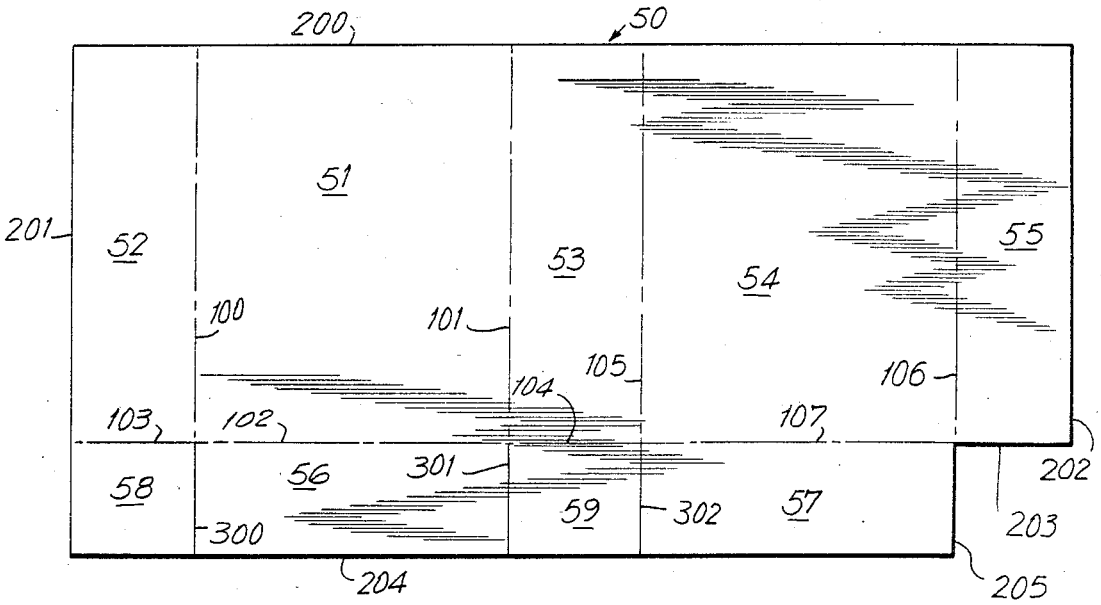
FIG. 5 is a plan view of a caddy member blank according to the invention.

A paperboard blank 50 from which caddy member 11 is preferably erected is shown in FIG. 5. Blank 50 has a front wall panel 51 defined by parallel long front-defining score lines 100, 101, a short front-defining score line 102 perpendicular to score lines 100, 101, and edge 200 of blank 50. A first outer side wall panel 52 is defined by score line 100, a first closure tab-defining score line 103 and edges 200, 201 of blank 50. A second outer side wall panel 53 is defined by score line 101, second closure tab-defining score line score line 104, a long rear-defining score line 105 and edge 200 of blank 50. A rear wall panel 54 is defined by parallel long rear-defining score lines 105, 106, short rear-defining score line 107 perpendicular to score lines 105, 106, and edge 200 of blank 50. An inner side wall panel 55 is defined by score line 106 and edges 200, 202, 203 of blank 50. An outer bottom wall panel 56 is defined by score line 102, cuts 300, 301 and edge 204 of blank 50. An inner bottom wall panel 157 is defined by score line 107, cut 302, and edges 204, 205 of blank 50. A first closure tab 58 is defined by score line 103, cut 300 and edges 201, 204 of blank 50. A second closure tab 59 is defined by score line 104, cuts 301, 302, and edge 204 of blank 50.

Figure 6:
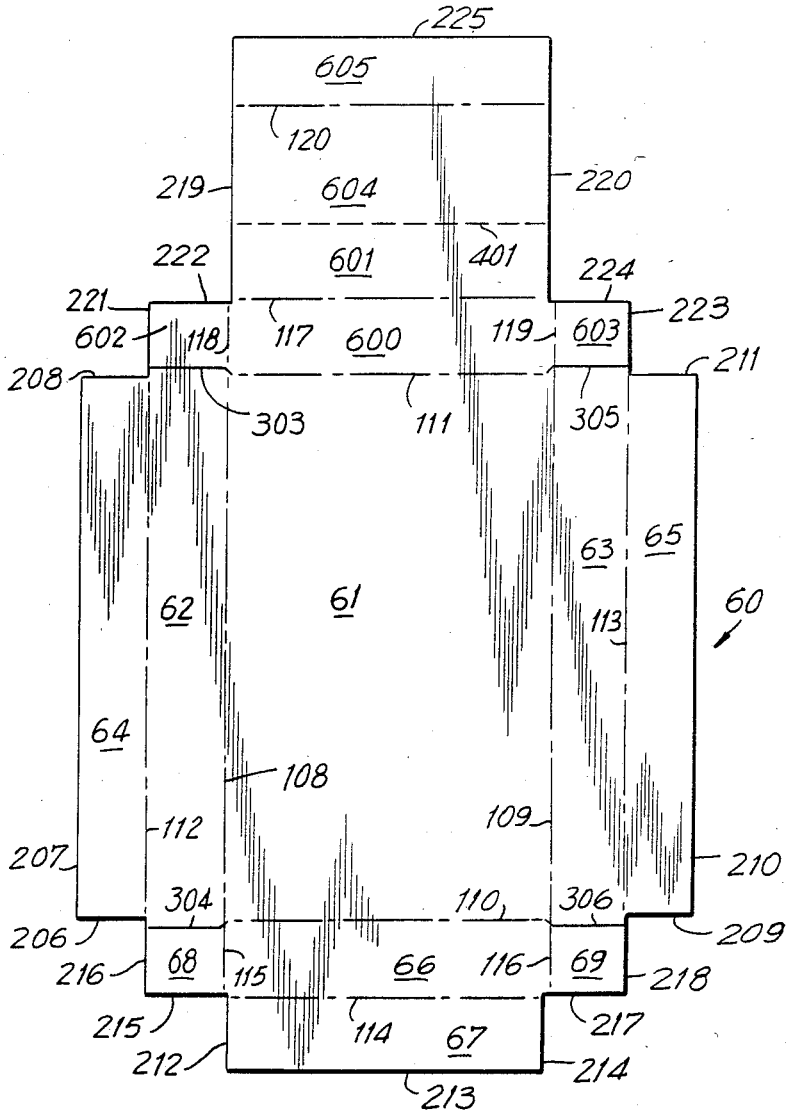
FIG. 6 is a plan view of a back cover member blank for the embodiment of FIGS. 1–4.

A paperboard blank 60 from which back cover member 12 is preferably erected is shown in FIG. 6. A rear face panel 61 is defined by parallel long rear face-defining score lines 108, 109 and parallel short rear face-defining score lines 110, 111 perpendicular to score lines 108, 109. A first outer side rim panel 62 is defined by score line 108, a first side rim-defining score line 112 parallel to score line 108, and cuts 303, 304. A second outer side rim panel 63 is defined by score line 109, a second side rim-defining score line 113 parallel to score line 109, and cuts 305, 306. A first inner side rim panel 64 is defined by score line 112 and edges 206, 207, 208 of blank 60. A second inner side rim panel 65 is defined by score line 113 and edges 209, 210, 211 of blank 60. An outer bottom rim panel 66 is defined by score line 110, long bottom rim-defining score line 114 parallel to score line 110, and short bottom rim-defining score lines 115, 116 perpendicular to score line 110. An inner bottom rim panel 67 is defined by score line 114 and edges 212, 213, 214 of blank 60. A first bottom rim closure tab 68 is defined by score line 115, cut 304 and edges 215, 216 of blank 60. A second bottom rim closure tab 69 is defined by score line 116, cut 306, and edges 217, 218 of blank 60. An outer top rim panel 600 is defined by score line 111, long top rim-defining score line 117 parallel to score line 111, and short top rim-defining score lines 118, 119 perpendicular to score line 111. An inner top rim panel 601 is defined by score line 117, perforation line 401 parallel to score line 116, and edges 219, 220 of blank 60. A first top rim closure tab 602 is defined by score line 118, cut 303 and edges 221, 222 of blank 60. A second top rim closure tab 603 is defined by score line 119, cut 305, and edges 223, 224 of blank 60. A rear lifting web panel 604 is defined by perforation line 401, rear lifting score line 120, and edges 219, 220 and blank 60. A rear lifting tab 605 is defined by score line 120 and edges 219, 220, 225 of blank 60.

Figure 7:
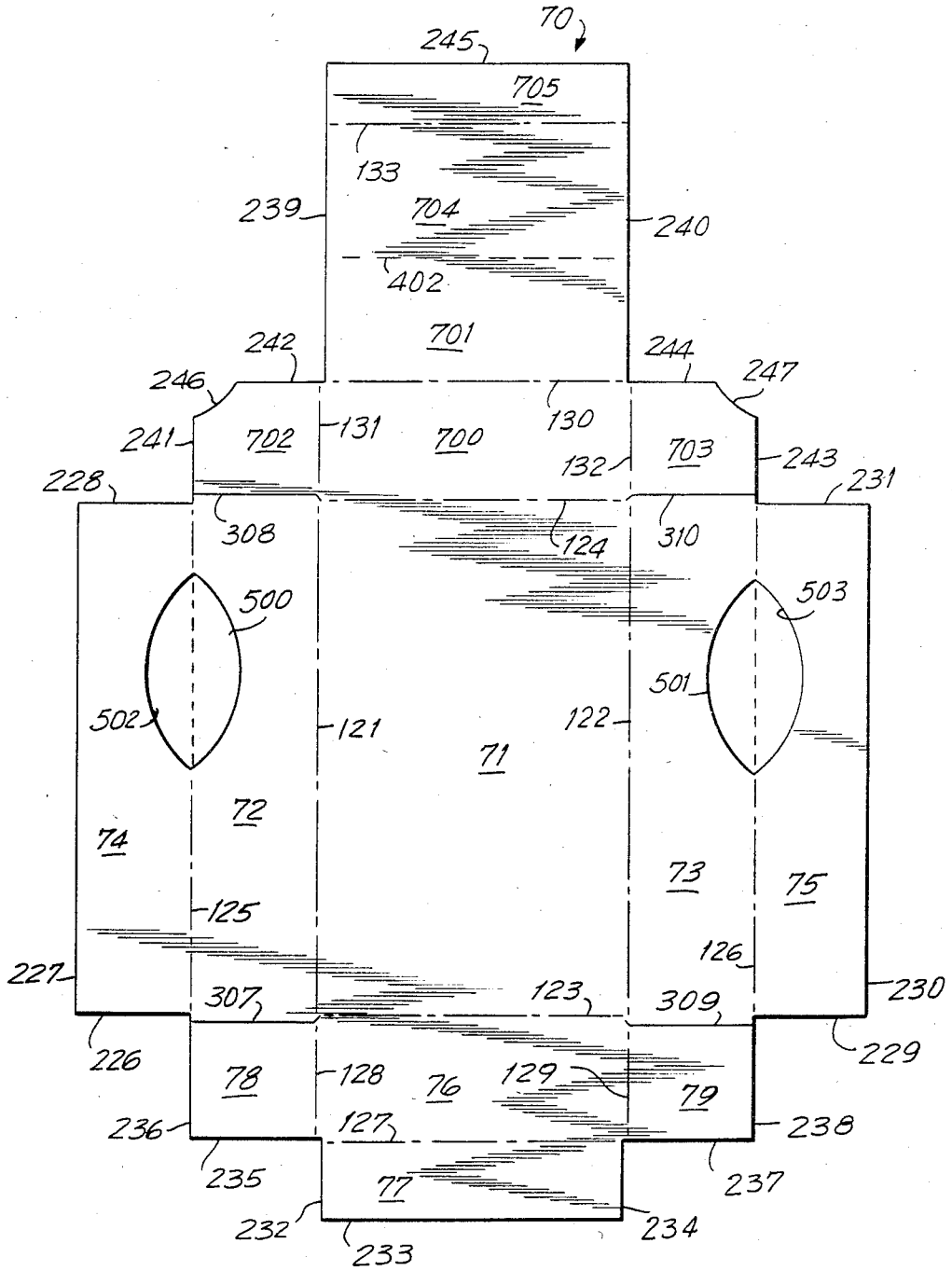
FIG. 7 is a plan view of a front cover member blank for the embodiment of FIGS. 1–4.

A paperboard blank 70 from which front cover member 13 is preferably erected is shown in FIG. 7. A front face panel 71 is defined by parallel long front face-defining score lines 121, 122 and parallel short front face-defining score lines 123, 124 perpendicular to score lines 121, 122. A first outer side skirt panel 72 is defined by score line 121, a first side skirt-defining score line 125 parallel to score line 121, and cuts 307, 308. A first partial circular cutout 500 is cut from panel 72 along score line 125. A second outer side skirt panel 73 is defined by score line 122, a second side skirt-defining score line 126 parallel to score line 122, and cuts 309, 310. A second partial circular cutout 501 is cut from panel 73 along score line 126. A first inner side skirt panel 74 is defined by score line 125 and edges 226, 227, 228 of blank 70. A third partial circular cutout 502 is cut from panel 74 along score line 125 opposite first partial circular cutout 500. A second inner side skirt panel 75 is defined by score line 126 and edges 229, 230, 231 of blank 70. A fourth partial circular cutout 503 is cut from panel 75 along line 126 opposite second partial circular cutout 501. An outer bottom skirt panel 76 is defined by score line 123, a long bottom skirt-defining score line 127 parallel to score line 123, and parallel short bottom skirt-defining score lines 128, 129 perpendicular to score line 127. An inner bottom skirt panel 77 is defined by score lines 127 and edges 232, 233, 234 of blank 70. A first bottom skirt closure tab 78 is defined by score line 128, cut 307, and edges 235, 236 of blank 70. A second bottom skirt closure tab 79 is defined by score line 129, cut 309 and edges 237, 238 of blank 70. An outer top skirt panel 700 is defined by score line 124, long top skirt-defining score line 130 parallel to score line 124, and parallel short top skirt-defining score lines 131, 132 perpendicular to score line 124. An inner top skirt panel 701 is defined by score line 130, perforation line 402 parallel to score line 130, and edges 239, 240 of blank 70. A first top skirt closure tab 702 is defined by score line 131, cut 308, and edges 241, 242, 246 of blank 70. A second top skirt closure tab 703 is defined by score line 132, cut 310 and edges 243, 244, 247 of blank 70. A front lifting web panel 704 is defined by perforation line 402, front lifting score line 133 parallel to perforation line 402, and edges 239, 240 of blank 70. A front lifting tab 705 is defined by score line 133 and edges 239, 240, 245 of blank 70.

When blanks 50, 60 and 70 are erected, the rim panels of blank 60 form the top, bottom and side walls of back cover member 12 and the skirt panels of blank 70 form the top, bottom and side walls of front cover member 13. The folding over of panels 74 and 75 onto panels 72 and 73, respectively, of blank 70 forms the two notches 15 from the four partial circular cutouts 500–503. Inner bottom skirt panel 77 is adhered to outer bottom rim panel 67 to form hinge 21. Rear lifting tab 605 is adhered to rear wall panel 54 and front lifting tab 705 is adhered to front wall panel 51.

In the embodiment of FIGS. 1–4, back cover member 12 nests flush within front cover member 13. In the alternate embodiment shown in FIGS. 8–10, cigarette pack 80 has caddy member 20, back cover member 82, and front cover member 83. In this embodiment, cover members 82, 83 are approximately equal in depth and back cover member 82 protrudes from front cover member 83. Lifting webs 84, 85 are approximately equal in length so that caddy member 20 is centered between member 82, 83 when cigarette pack 80 is open. No notches are provided for opening cigarette pack 80 because protruding back cover member 82 is readily grasped, although notches may be provided if desired.

Because back cover member 82 does not extend as far into front cover member 83 as back cover member 12 does into front cover member 13, the frictional engagement between corners 802, 803 and the interior of front cover member 83 may not be sufficient to retain cigarette pack 80 in its closed position. Therefore a locking means may be provided. One such locking means is shown in FIGS. 9 and 10 and includes two resilient members 86, 87 protruding at opposing angles from opposing faces of cover members 82, 83. When cigarette pack 80 is closed, resilient members 84, 85 interlock to retain it in the closed position. However, members 84, 85 are sufficiently resilient to be pulled apart manually to allow cigarette pack 80 to be opened. Other suitable locking means may also be provided. Locking means can also be used in the embodiment of FIGS. 1–4, if desired.

The cigarette pack described herein provides a closed container which prevents the dropping out of loose tobacco. It is also attractive to smokers because of its novel means for opening. The exterior of the pack can be printed with brand and other information and with decorative material in the same manner as other cigarette packs. Similarly, the cigarettes contained within the pack can be wrapped in foil in the manner known to those skilled in the art, and the pack can be overwrapped with cellophane to keep the cigarettes fresh.

It will be apparent to those skilled in the art that the invention described herein can be practiced by other than the embodiments disclosed herein, which are presented for the purposes of illustration and not of limitation, and the present invention is limited only by the claims which follow.

What is claimed is:

1. A folding carton comprising:

a caddy member, said caddy member having a solid rectangular shape, and having a height shorter than the length of a cigarette, a width approximately an integral multiple of the diameter of a cigarette and a depth sufficient to accommodate a plurality of rows of cigarettes, said caddy member further having a front wall and a back wall each defined by said height and said width, first and second side walls defined by said height and said depth, and a bottom wall defined by said width and said depth;

a back cover member having a back wall, a top wall, a bottom wall, and two side walls, said back cover member nestingly engaging said back, side and bottom walls of said caddy member and having a height substantially the length of a cigarette;

a front cover member having a front wall, a top wall, a bottom wall, and two side walls, said front cover member nestingly engaging said front wall of said caddy member and said top, bottom and side walls of said back cover member;

a hinge connecting said bottom wall of said front cover member to said bottom wall of said back cover member for pivoting said front and back cover members between an open position and a closed position; and first lifting means connecting said caddy member to said front cover member and second lifting means connecting said caddy member to said back cover member whereby said caddy member is caused to project vertically from between said front and back cover members when said front and back cover members are moved to said open position and to retract between said front and back cover members when said front and back cover members are moved to said closed position, said first lifting means comprising a web hinged at a first end thereof to said caddy member and hinged at a second end thereof remote from said first end to said front cover member and said second lifting means comprising a web hinged at a first end thereof to said caddy member and hinged at a second end thereof remote from said first end to said back cover member;

said caddy member being erected from a first paperboard blank, said front cover member and said first lifting means being erected from a second paperboard blank, and said back cover member and said second lifting means being erected from a third paperboard blank; wherein said first blank comprises:

a front wall panel defined by a pair of parallel long front-defining score lines and a short front-defining score line perpendicular to said long front-defining score lines;

a first outer side wall panel connected to said front wall panel along one of said long front-defining score lines, and further defined by a first closure tab-defining score line perpendicular to said one of said long front-defining score lines;

a second outer side wall panel connected to said front wall panel along the other of said long front-defining score lines, and further defined by a second closure tab-defining score line perpendicular to said other of said long front-defining secure lines and by a first long rear-defining score line parallel to said long front-defining score lines;

a rear wall panel connected to said second outer side wall panel along said first long rear-defining score line, and further defined by a second long rear-defining score line parallel to said first long rear-defining score line and a short rear-defining score line perpendicular to said long rear-defining score lines;

an inner side wall panel connected to said rear wall panel along said second long rear-defining score line;

an outer bottom wall panel connected to said front wall panel along said short front-defining score line;

an inner bottom wall panel connected to said rear wall panel along said short rear-defining score line;

a first closure tab connected to said first outer side wall panel along said first closure tab-defining score line; and a second closure tab connected to said second outer side wall panel along said second closure tab-defining score line.

2. A folding carton comprising:

a caddy member, said caddy member having a solid rectangular shape, and having a height shorter than the length of a cigarette, a width approximately an integral multiple of the diameter of a cigarette and a depth sufficient to accommodate a plurality of rows of cigarettes, said caddy member further having a front wall and a back wall each defined by said height and said width, first and second side walls defined by said height and said depth, and a bottom wall defined by said width and said depth;

a back cover member having a back wall, a top wall, a bottom wall, and two side walls, said back cover member nestingly engaging said back, side and bottom walls of said caddy member and having a height substantially the length of a cigarette;

a front cover member having a front wall, a top wall, a bottom wall, and two side walls, said front cover member nestingly engaging said front wall of said caddy member and said top, bottom and side walls of said back cover member;

a hinge connecting said bottom wall of said front cover member to said bottom wall of said back cover member for pivoting said front and back cover members between an open position and a closed position; and first lifting means connecting said caddy member to said front cover member and second lifting means connecting said caddy member to said back cover member whereby said caddy member is caused to project vertically from between said front and back cover members when said front and back cover members are moved to said open position and to retract between said front and back cover members when said front and back cover members are moved to said closed position, said first lifting means comprising a web hinged at a first end thereof to said caddy member and hinged at a second end thereof remote from said first end to said front cover member and said second lifting means comprising a web hinged at a first end thereof to said caddy member and hinged at a second end thereof remote from said first end to said back cover member;

said caddy member being erected from a first paperboard blank, said front cover member and said first lifting means being erected from a second paperboard blank, and said back cover member and said second lifting means being erected from a third paperboard blank; wherein said second blank comprises:

a front face panel defined by a pair of parallel long front face-defining score lines and a pair of parallel short front face-defining score lines perpendicular to said long front face-defining score lines;

a first outer side skirt panel connected to said front face panel along one of said long front face-defining score lines, said first outer side skirt panel further defined by a first side skirt-defining score line parallel to said long front face-defining score lines, and having a first partial circular cutout along said first side skirt-defining score line;

a second outer side skirt panel connected to said front face panel along the other of said long front face-defining score lines, said second outer side skirt panel further defined by a second side skirt-defining score line parallel to said long front face-defining score lines, and having a second partial circular cutout along said second side skirt-defining score line;

a first inner side skirt panel connected to said first outer side skirt panel along said first side skirt-defining score line and having a third partial circular cut-out adjacent said first partial circular cutout;

a second inner side skirt panel connected to said second outer side skirt panel along said second side skirt-defining score line and having a fourth partial circular cutout adjacent said second partial circular cutout;

an outer bottom skirt panel connected to said front face panel along one of said short front face-defining score lines, and further defined by a long bottom skirt-defining score line parallel to said short front face-defining score lines and by a pair of parallel short bottom skirt-defining score lines perpendicular to said long bottom skirt-defining score line;

an inner bottom skirt panel connected to said outer bottom skirt panel along said long bottom skirt-defining score line;

a first bottom skirt closure tab connected to said outer bottom skirt panel along one of said short bottom skirt-defining score lines;

a second bottom skirt closure tab connected to said outer bottom skirt panel along the other of said short bottom skirt-defining score lines;

an outer top skirt panel connected to said front face panel along the other of said short front face-defining score lines, and further defined by a long top skirt-defining score line parallel to said short front face-defining score lines and by a pair of parallel short top skirt-defining score lines perpendicular to said long top skirt-defining score line;

an inner top skirt panel connected to said outer top skirt panel along said long top skirt-defining score line, and further defined by a front perforation line;

a first top skirt closure tab connected to said outer top skirt panel along one of said short top skirt-defining score lines;

a second top skirt closure tab connected to said outer top skirt panel along the other of said short top skirt-defining score lines;

a front lifting web panel connected to said inner top skirt panel along said front perforation line and further defined by a front lifting score line; and a front lifting tab connected to said front lifting web panel along said front lifting score line.

3. A folding carton comprising:

a caddy member, said caddy member having a solid rectangular shape, and having a height shorter than the length of a cigarette, a width approximately an integral multiple of the diameter of a cigarette and a depth sufficient to accommodate a plurality of rows of cigarettes, said caddy member further having a front wall and a back wall each defined by said height and said width, first and second side walls defined by said height and said depth, and a bottom wall defined by said width and said depth;

a back cover member having a back wall, a top wall, a bottom wall, and two side walls, said back cover member nestingly engaging said back, side and bottom walls of said caddy member and having a height substantially the length of a cigarette;

a front cover member having a front wall, a top wall, a bottom wall, and two side walls, said front cover member nestingly engaging said front wall of said caddy member and said top, bottom and side walls of said back cover member;

a hinge connecting said bottom wall of said front cover member to said bottom wall of said back cover member for pivoting said front and back cover members between an open position and a closed position; and first lifting means connecting said caddy member to said front cover member and second lifting means connecting said caddy member to said back cover member whereby said caddy member is caused to project vertically from between said front and back cover members when said front and back cover members are moved to said open position and to retract between said front and back cover members when said front and back cover members are moved to said closed position, said first lifting means comprising a web hinged at a first end thereof to said caddy member and hinged at a second end thereof remote from said first end to said front cover member and said second lifting means comprising a web hinged at a first end thereof to said caddy member and hinged at a second end thereof remote from said first end to said back cover member;

said caddy member being erected from a first paperboard blank, said front cover member and said first lifting means being erected from a second paperboard blank, and said back cover member and said second lifting means being erected from a third paperboard blank; wherein said third blank comprises:

a rear face panel defined by a pair of parallel long rear face-defining score lines and a pair of parallel short rear face-defining score lines perpendicular to said long rear face-defining score lines;

a first outer side rim panel connected to said rear face panel along one of said long rear face-defining score lines, said first outer side rim panel further defined by a first side rim-defining score line parallel to said long rear face-defining score lines;

a second outer side rim panel connected to said rear face panel along one of said long rear face-defining score lines, said second outer side rim panel further defined by a second side rim-defining score line parallel to said long rear face-defining score lines;

a first inner side rim panel connected to said first outer side rim panel along said first side rim-defining score line;

a second inner side rim panel connected to said second outer side rim panel along said second side rim-defining score line;

an outer bottom rim panel connected to said rear face panel along one of said short rear face-defining score lines, and further defined by a long bottom rim-defining score line parallel to said short rear face-defining score lines and by a pair of parallel short bottom rim-defining score lines perpendicular to said long bottom rim-defining score line;

an inner bottom rim panel connected to said outer bottom rim panel along said long bottom rim-defining score line;

a first bottom rim closure tab connected to said outer bottom rim panel along one of said short bottom rim-defining score lines;

a second bottom rim closure tab connected to said outer bottom rim panel along the other of said short bottom rim-defining score lines;

an outer top rim panel connected to said rear face panel along the other of said short rear face-defining score lines, and further defined by a long top rim-defining score line parallel to said short rear face-defining score lines and by a pair of parallel short top rim-defining score lines perpendicular to said long top rim-defining score line;

an inner top rim panel connected to said outer top rim panel along said long top rim-defining score line and further defined by a second perforation line;

a first top rim closure tab connected to said outer top rim panel along one of said short top rim-defining score lines;

a second top rim closure tab connected to said outer top rim panel along the other of said short top rim-defining score lines;

a rear lifting web panel connected to said inner top rim panel along said second perforation line, and further defined by a rear lifting score line; and a rear lifting tab connected to said rear lifting web panel along said rear lifting score line.

4. A folding carton comprising:

a caddy member, said caddy member having a solid rectangular shape, and having a height shorter than the length of a cigarette, a width approximately an integral multiple of the diameter of a cigarette and a depth sufficient to accommodate a plurality of rows of cigarettes, said caddy member further having a front wall and a back wall each defined by said height and said width, first and second side walls defined by said height and said depth, and a bottom wall defined by said width and said depth;

a back cover member having a back wall, a top wall, a bottom wall, and two side walls, said back cover member nestingly engaging said back, side and bottom walls of said caddy member and having a height substantially the length of a cigarette;

a front cover member having a front wall, a top wall, a bottom wall, and two side walls, said front cover member nestingly engaging said front wall of said caddy member and said top, bottom and side walls of said back cover member;

a hinge connecting said bottom wall of said front cover member to said bottom wall of said back cover member for pivoting said front and back cover members between an open position and a closed position; and first lifting means connecting said caddy member to said front cover member and second lifting means connecting said caddy member to said back cover member whereby said caddy member is caused to project vertically from between said front and back cover members when said front and back cover members are moved to said open position and to retract between said front and back cover members when said front and back cover members are moved to said closed position, said first lifting means comprising a web hinged at a first end thereof to said caddy member and hinged at a second end thereof remote from said first end to said front cover member and said second lifting means comprising a web hinged at a first end thereof to said caddy member and hinged at a second end thereof remote from said first end to said back cover member;

said caddy member being erected from a first paperboard blank, said front cover member and said first lifting means being erected from a second paperboard blank, and said back cover member and said second lifting means being erected from a third paperboard blank; wherein:

said first blank comprises:

a front wall panel defined by a pair of parallel long front-defining score lines and a short front-defining score line perpendicular to said long front-defining score lines;

a first outer side wall panel connected to said front wall panel along one of said long front-defining score lines, and further defined by a first closure tab-defining score line perpendicular to said one of said long front-defining score lines;

a second outer side wall panel connected to said front wall panel along the other said long front-defining score lines, and further defined by a second closure tab-defining score line perpendicular to said other of said long front-defining score lines and by a first long rear-defining score line parallel to said long front-defining score lines;

a rear wall panel connected to said second outer side wall panel along said first long rear-defining score line, and further defined by a second long rear-defining score line parallel to said first long rear-defining score line and a short rear-defining score line perpendicular to said long rear-defining score lines;

an inner side wall panel connected to said rear wall panel along said second long rear-defining score line;

an outer bottom wall panel connected to said front wall panel along said short front-defining score line;

an inner bottom wall panel connected to said rear wall panel along said short rear-defining score line;

a first closure tab connected to said first outer side wall panel along said first closure tab-defining score line; and a second closure tab connected to said second outer side wall panel along said second closure tab-defining score line;

said second blank comprises:

a front face panel defined by a pair of parallel long front face-defining score lines and a pair of parallel short front face-defining score lines perpendicular to said long front face-defining score lines;

a first outer side skirt panel connected to said front face panel along one of said long front face-defining score lines, said first outer side skirt panel further defined by a first side skirt-defining score line parallel to said long front face-defining score lines, and having a first partial circular cutout along said first side skirt-defining score line;

a second outer side skirt panel connected to said front face panel along the other of said long front face-defining score lines, said second outer side skirt panel further defined by a second side skirt-defining score line parallel to said long front face-defining score lines, and having a second partial circular cutout along said second side skirt-defining score line;

a first inner side skirt panel connected to said first outer side skirt panel along said first side skirt-defining score line and having a third partial circular cutout adjacent said first partial circular cutout;

a second inner side skirt panel connected to said second outer side skirt panel along said second side skirt-defining score line and having a fourth partial circular cutout adjacent said second partial circular cutout;

an outer bottom skirt panel connected to said front face panel along one of said short front face-defining score lines, and further defined by a long bottom skirt-defining score line parallel to said short front face-defining score lines and by a pair of parallel short bottom skirt-defining score lines perpendicular to said long bottom skirt-defining score line;

an inner bottom skirt panel connected to said outer bottom skirt panel along said long bottom skirt-defining score line;

a first bottom skirt closure tab connected to said outer bottom skirt panel along one of said short bottom skirt-defining score lines;

a second bottom skirt closure tab connected to said outer bottom skirt panel along the other of said short bottom skirt-defining score lines;

an outer top skirt panel connected to said front face panel along the other of said short front face-defining score lines, and further defined by a long top skirt-defining score line parallel to said short front face-defining score lines and by a pair of parallel short top skirt-defining score lines perpendicular to said long top skirt-defining score line;

an inner top skirt panel connected to said outer top skirt panel along said long top skirt-defining score line, and further defined by a front perforation line;

a first top skirt closure tab connected to said outer top skirt panel along one of said short top skirt-defining score lines;

a second top skirt closure tab connected to said outer top skirt panel along the other of said short top skirt-defining score lines;

a front lifting web panel connected to said inner top skirt panel along said front perforation line and further defined by a front lifting score line; and a front lifting tab connected to said front lifting web panel along said front lifting score line; and said third blank comprises:

a rear face panel defined by a pair of parallel long rear face-defining score lines and a pair of parallel short rear face-defining score lines perpendicular to said long rear face-defining score lines;

a first outer side rim panel connected to said rear face panel along one of said long rear face-defining score lines, said first outer side rim panel further defined by a first side rim-defining score line parallel to said long rear face-defining score lines;

a second outer side rim panel connected to said rear face panel along one of said long rear face-defining score lines, said second outer side rim panel further defined by a second side rim-defining score line parallel to said long rear face-defining score lines;

a first inner side rim panel connected to said first outer side rim panel along said first side rim-defining score line;

a second inner side rim panel connected to said second outer side rim panel along said second side rim-defining score line;

an outer bottom rim panel connected to said rear face panel along one of said short rear face-defining score lines, and further defined by a long bottom rim-defining score line parallel to said short rear face-defining score lines and by a pair of parallel short bottom rim-defining score lines perpendicular to said long bottom rim-defining score line;

an inner bottom rim panel connected to said outer bottom rim panel along said long bottom rim-defining score line;

a first bottom rim closure tab connected to said outer bottom rim panel along one of said short bottom rim-defining score lines;

a second bottom rim closure tab connected to said outer bottom rim panel along the other of said short bottom rim-defining score lines;

an outer top rim panel connected to said rear face panel along the other of said short rear face-defining score lines, and further defined by a long top rim-defining score line parallel to said short rear face-defining score lines and by a pair of parallel short top rim-defining score lines perpendicular to said long top rim-defining score line;

an inner top rim panel connected to said outer top rim panel along said long top rim-defining score line and further defined by a second perforation line;

a first top rim closure tab connected to said outer top rim panel along one of said short top rim-defining score lines;

a second top rim closure tab connected to said outer top rim panel along the other of said short top rim-defining score lines;

a rear lifting web panel connected to said inner top rim panel along said second perforation line, and further defined by a rear lifting score line; and a rear lifting tab connected to said rear lifting web panel along said rear lifting score line; wherein said hinge is formed by the adhesion of said inner bottom skirt panel to said outer bottom rim panel;

said front lifting tab is adhered to said front wall panel; and said rear lifting tab is adhered to said rear wall panel.

5. The folding carton of claim 4 wherein said back cover member is in flush nesting engagement within said front cover member and said front lifting web panel is longer than said rear lifting web panel.

6. The folding carton of claim 4 wherein said back cover member is in protruding nesting engagement within said front cover member and said front and rear lifting web panels are substantially equal in length.

7. The folding carton of claim 4 further comprising means for locking said front and back cover members in said closed position.

* * * * *